United States Patent [19]

Carlson

[11] Patent Number: 5,032,307

[45] Date of Patent: Jul. 16, 1991

[54] SURFACTANT-BASED ELECTRORHEOLOGICAL MATERIALS

[75] Inventor: J. David Carlson, Cary, N.C.

[73] Assignee: Lord Corporation, Erie, Pa.

[21] Appl. No.: 508,390

[22] Filed: Apr. 11, 1990

[51] Int. Cl.[5] ..... C10N 40/14; C09K 3/00

[52] U.S. Cl. ..... 252/73; 252/77; 252/78.1; 252/78.3; 252/570; 252/572

[58] Field of Search ..... 252/74, 75, 77, 78.3, 252/572, 78.1, 73, 49.3, 49.5, 570

[56] References Cited

U.S. PATENT DOCUMENTS

| | | | |
|---|---|---|---|
| 2,661,596 | 12/1953 | Winslow | 60/326 |
| 2,661,825 | 12/1953 | Winslow | 192/21.5 |
| 3,047,507 | 7/1962 | Winslow | 252/75 |
| 3,250,726 | 5/1966 | Martinek et al. | 252/75 |
| 3,367,872 | 2/1968 | Martinek et al. | 252/74 |
| 3,385,793 | 5/1968 | Klass et al. | 252/75 |
| 3,427,247 | 2/1969 | Peck | 252/75 |
| 4,645,614 | 2/1987 | Goossens et al. | 252/78.3 |
| 4,702,855 | 10/1987 | Goossens et al. | 252/573 |
| 4,772,407 | 9/1988 | Carlson | 252/74 |
| 4,849,122 | 7/1989 | Imai et al. | 252/73 |

FOREIGN PATENT DOCUMENTS 0206525 12/1986 European Pat. Off. .

OTHER PUBLICATIONS

Matsepuro, "Structure Formation in an Electric Field and the Composition of Electrorheological Suspensions", translated from Elektroreol. Issled; Pril., Minsk, pp. 27–51, 1981.

Chemical Abstracts, "Rheological Transformers", CA98(14): 109679c, Shulman, 1981.

McCutcheon's Detergents and Emulsifiers, 1976 Edition, p. 157.

Rosen, "Surfactants and Interfacial Phenomena," 2nd Edition, 1988, pp. 7–31.

*Primary Examiner*—Paul Lieberman
*Assistant Examiner*—Christine A. Skane
*Attorney, Agent, or Firm*—W. Graham Buie

[57] ABSTRACT

An electrorheological material containing a carrier fluid, an anionic surfactant particle component, and an activator. The non-abrasive anionic surfactant acts as both a particle component and a surfactant and the electrorheological material is miscible with water and will not mar the surface of objects utilized in an electrorheological device.

14 Claims, No Drawings

SURFACTANT-BASED ELECTRORHEOLOGICAL MATERIALS

FIELD OF THE INVENTION

The present invention relates to fluid compositions which exhibit substantial changes in rheological properties when exposed to electric fields. More specifically, the present invention relates to an electrorheological material which utilizes an anionic surfactant as the active particle component.

BACKGROUND OF THE INVENTION

Electrorheological materials are fluid compositions which exhibit substantial changes in rheological properties in the presence of an electric field. Electrorheological materials typically consist of (1) a carrier fluid, (2) a particle component, (3) an activator, and (4) a surfactant. The surfactant of the electrorheological material is utilized to disperse the particle component within the carrier fluid while the activator is utilized to impart electroactivity to the particle component. In the presence of an electric field, the particle component becomes organized so as to increase the apparent viscosity or flow resistance of the overall fluid. Therefore, by manipulating the electric field, one can selectively change the apparent viscosity or flow resistance of an electrorheological material to achieve desired results in various known devices and applications.

In the absence of an electric field, electrorheological materials exhibit approximately Newtonian behavior; specifically, their shear stress (applied force per unit area) is directly proportional to the shear rate (relative velocity per unit thickness). When an electric field is applied, a yield stress phenomenon appears and no shearing takes place until the shear stress exceeds a yield value which rises with increasing electric field strength. This phenomenon can appear as an increase in apparent viscosity of several, and indeed many, order of magnitude.

The mechanism responsible for the observed behavior of electrorheological materials is believed to be an induced polarization of the particle component (particles) followed by a mutual interaction of the polarized particles to form a filamentary structure. In general, the particles in an electrorheological material are able to polarize due to internal or surface conductivity which leads to Maxwell-Wagner polarization when an external field is applied. Although polarization can also occur due to electronic or atomic distortions and the orientation of molecular dipoles, i.e. the real part of the dielectric constant, conduction and subsequent Maxwell-Wagner polarization will dominate at low frequency.

Induced polarization in most electrorheological materials, particularly the so called "water-activated" materials is due to ionic conduction. Adsorbed water on the surface of these particles form an electrolyte with Ca or an alkali metal such as Na, K or Li which are generally present as impurities or are added on purpose to form mobile cations. These cations move through the pores and along the surface of the particles under the influence of an external field to form induced dipoles. An activator such as water is required by these electrorheological materials in order to solvate the cations. If the activator is removed, the ions are no longer mobile and polarization can no longer occur or occurs so slowly that little electrorheological effect is observed. The activator for these materials can also be solvents or molecules containing an amine or an alcohol functionality such as ethylene glycol, diethylamine or acetamide such as is discussed in U.S. Pat. No. 3,427,247 and Matsepuro, "Structure Formation in an Electric Field and the Composition of Electrorheological Suspensions," Royal Aircraft Establishment Library Translation 2110, July 1983.

For electrorheological materials in general, a higher volume fraction of particle component affords a higher induced yield stress and the relationship between induced yield stress and volume fraction has been found to be approximately linear for volume fractions up to about 50%. Volume fractions greater than 50% are generally not used since the materials become very strongly dilatant above this point. Above a 50% volume fraction the zero-field viscosity and zero-field yield stress increases so rapidly that the proportional change in stress due to the applied electric field is actually less than that obtained for a volume fraction less than 50%.

Particle size has little influence on the magnitude of the electrorheological effect as long as the particles have a diameter more or less within the range of 0.1 to 100 microns. Particles smaller than this range may show a decreased effect due to competition from thermal effects, e.g. Brownian motion, which tends to inhibit formation of particle chains when the electric field induced particle-particle interaction energy is less than or on the same order as the thermal energy kT/2. Particles larger than the above range will continue to exhibit an electrorheological effect; however, they become increasingly difficult to maintain in suspension and are subject to jamming and filter cake packing, i.e. the particles chain but the continuous phase liquid continues to move between them. These effects are minimized by keeping the particle small enough such that the Stokes drag forces experienced by a particle are of the same order as the electric field induced forces.

At a fixed electric field strength, the shear stress of electrorheological materials generally increases linearly with shear rate. The rate of stress increase with increasing shear rate is the plastic viscosity of the electrorheological material. The plastic viscosity is, in general, equal to the zero-field or Newtonian viscosity of the electrorheological material.

Many different types of specific electrorheological materials have been previously developed in an attempt to optimize the parameters and properties discussed above. For example, an electrorheological material utilizing silica gel as the particle component and electrically stable dielectric oily vehicles such as white oils and transformer oils as the carrier fluid is disclosed in U.S. Pat. No. 2,661,596. Water is used as the activator while various dispersing agents such as sorbitol sesquioleate, ferrous oleate, sodium oleate, and sodium naphthenate are utilized as surfactants. Similarly, U.S. Pat. No. 2,661,825 discloses an electrorheological material which utilizes carbonile iron powder or silica gel as the particle component and mineral oil or kerosene as the carrier fluid. Various activators mentioned include water, ethylene glycol, and mono ethyl ether while surfactants utilized include aluminum stearates, lithium stearate, lithium rasinoleate, sorbitol sesquioleate, and lauryl peridinium chloride.

An electrorheological material composed of a nonconductive solid particle component dispersed within an oleaginous carrier fluid is described in U.S. Pat. No. 3,047,507. The compositions utilize as an activator a minimum amount of water and utilize as a surfactant various anionic and cationic surface active agents such as fatty acids, naphthenic acids, resinic acids, various salts of these acids, and primary amines. Also, U.S. Pat. No. 3,367,872 discloses an electrorheological material which utilizes alumina or silica alumina as the particle component and an oleaginous vehicle as the carrier fluid. Water is described as the activator and various anionic and cationic agents such as alkyl aryl sulfonates, sulfated alcohols, oleyl alcohol sulfates, lauryl alcohol sulfates, various sodium alkyl sulfates, quaternary ammonium salts, and salts of higher alkyl amines are described as surfactants.

Traditional electrorheological materials such as the materials described above require both a particle component and a surfactant in order to perform effectively in various applications. It would be desirable to eliminate the need for both a particle component and a surfactant in present electrorheological materials.

Turning to more specific applications, in order to fulfill their potential as a unique interface between electronic controls and mechanical systems, appropriate electrorheological materials must demonstrate certain practical characteristics. For example, in certain applications an electrorheological material should be miscible with water to facilitate handling of the material and cleaning of mechanical systems containing the material. Also, in applications involving mechanical components or objects having delicate surfaces, the dispersed phase particles should be non-abrasive. As would be expected, the chemical nature of the carrier fluid, the particle component, and any resulting combination should be compatible with the mechanical materials used to produce the electrorheological device.

One particular group of applications in which it is desirable that electrorheological materials exhibit miscibility with water are fixturing and chucking applications in which electrorheological materials are used to hold or secure an object firmly in place so that it may be machined, measured, gauged or otherwise inspected. Examples of such electrorheological material-based chucking devices are disclosed in U.S. Pat. Nos. 3,197,682 and 3,253,200. One problematic aspect of such devices is that the object to be held is placed in contact with the electrorheological material and after the chucking process is complete an undesirable residue of electrorheological material remains on the surface of the object. This residue is generally oily in nature and may often be pigmented depending on the nature of the dispersed phase. Cleaning of the object after the chucking process is a problem with normal electrorheological materials such as silicates in silicone oil or pigmented fluids. Any advantage incurred by the electrorheological material chucking device may be lost due to the additional time required to clean the part.

It is also important to utilize a non-abrasive particle component in such chucking device applications as well as in other applications such as clutching devices in order to avoid scratching or marring of any object or component surface. Non-abrasive dispersed phase particles are particularly desirable in chucking applications involving parts having a delicate surface finish.

Therefore, it would be desirable to create electrorheological materials which are miscible with water and yet which are physically, mechanically, and chemically compatible with applied systems.

SUMMARY OF THE INVENTION

The present invention is an electrorheological material which eliminates the need for both a particle component and a surfactant and which is uniquely compatible with certain applied systesms. The present electrorheological material is exceptionally well suited for use in chucking device applications or other mechanical systems requiring frequent cleaning since the material is essentially self-cleaning due to its miscibility with water and is based on a soft, non-abrasive particle component that will not mar delicate surfaces.

It has presently been discovered that certain anionic surfactant compositions will function as both the particle component and surfactant of an electrorheological material. More specifically, the present invention comprises an electrically insulating hydrophobic liquid as the carrier fluid, an anionic surfactant as the particle component, and water or other molecule containing hydroxyl, carboxyl or amine functionality as the activator. The anionic surfactant acts as both the particle component and surfactant and therefore no additional surfactant is needed for the material of the present invention. The present non-abrasive electrorheological material is also miscible with water so as to facilitate cleaning and exhibits sufficient electrorheological activity to be useful in known electrorheological devices.

It is therefore an object of the present invention to provide an electrorheological material which eliminates the need for both a particle component and a surfactant.

It is another object of the present invention to provide an electrorheological material which will demonstrate appropriate electrorheological capabilities and improved handling characteristics that facilitate the cleaning of mechanical systems containing the material.

It is still another object of the present invention to provide an electrorheological material which exhibits appropriate electrorheological capabilities and is miscible with water.

It is yet another object of the present invention to provide an electrorheological material which utilizes a soft, non-abrasive material as the particle component.

DETAILED DESCRIPTION OF THE INVENTION

The present invention relates to an electrorheological material comprising a carrier fluid, a particle component, and an activator wherein the particle component is a non-abrasive, water-soluble anionic surfactant which behaves as both an electrorheological particle and a dispersing agent.

The carrier fluid of the invention is a continuous liquid phase and may be selected from any of a large number of electrically insulating, hydrophobic liquids known for use in electrorheological materials. Typical liquids useful in the present invention include mineral oils, white oils, paraffin oils, chlorinated hydrocarbons such as 1-chlorotetradecane, silicone oils, transformer oils, halogenated aromatic liquids, halogenated paraffins, polyoxyalkylenes, fluorinated hydrocarbons and mixtures thereof. Silicone oils having viscosities of between about 0.65 and 1000 milli Pascal seconds (mPa·s) are the preferred carrier fluids of the invention. As known to those familiar with such compounds, transformer oils refer to those liquids having characteristic properties of both electrical and thermal insulation. Naturally occurring transformer oils include refined mineral oils which have low viscosity and high chemical stability. Synthetic transformer oils generaly comprise chlorinated aromatics (chlorinated biphenyls and trichlorobenzene) which are known collectively as "askarels", silicone oils, and esteric liquids such as dibutyl sebacates. The carrier fluid is utilized in an amount from about 50 to about 90, preferably from about 55 to about 70 percent by weight of the final electrorheological material.

The particle component of the present invention can essentially be any known anionic surfactant. Preferred are anionic surfactants containing a long lipophilic tail bonded to a water-soluble (hydrophilic) group at the other end. In solution, an anionic surfactant ionizes in such a way that the hydrophilic group carries a negative charge. A cation, which is typically sodium but can also be one of the other alkali metals or ammonium, is attracted to the negative charge and can move under the influence of an applied electric field to polarize the particle. The lipophilic tail is preferably an alkyl group typically having from about 8 to 21 carbon atoms.

Typical anionic surfactants include carboxylic acid salts such as fatty acid salts having the formula $R_1COOR_2$ wherein $R_1$ is a straight chain, saturated or unsaturated, hydrocarbon radical of 8 to 21 carbon atoms and $R_2$ is a base-forming radical such as Li, Na, K or $NH_4$ which makes the detergent-like surfactant soluble in water. Typical fatty acid salts include sodium stearate, sodium palmitate, ammonium oleate, and triethanolamine palmitate. Additional carboxylic acid salts useful as anionic surfactants of the invention include sodium and potassium salts of coconut oil fatty acids and tall oil acids as well as other carboxylic acid salt compounds including amine salts such as triethanolamine salts, acylated polypeptides and salts of N-lauroyl sarcosine such as N-dodecanoyl-N-methylglycine sodium salt.

Other anionic surfactants useful in the present invention include aryl and alkyl aryl sulfonates such as alkylbenzene sulfonate, linear alkylbenzene sulfonates, sodium tetrapropylene benzene sulfonate, sodium dodecylbenzene sulfonate, benzene-, toluene-, xylene- and cumenesulfonates; ligninsulfonates; petroleum sulfonates; paraffin sulfonates; secondary n-alkane-sulfonates; α-olefin sulfonates; alkylnapthalene sulfonates, n-acyl-n-alkyltaurates; sulfosuccinate esters; isethionates; alkyl sulfates having the formula $R_1OSO_3R_2$ wherein $R_1$ and $R_2$ are as defined above, such as lithium dodecyl sulfate, sodium dodecyl sulfate, potassium dodecyl sulfate, and sodium tetradecyl sulfate; alkyl sulfonates having the formula $R_1SO_3R_2$ wherein $R_1$ and $R_2$ are as defined above, such as sodium lauryl sulfonate; sulfated and sulfonated amides and amines; sulfated and sulfonated esters such as lauric monoglyceride sodium sulfate, sodium sulphoethyl oleate, and sodium lauryl sulphoacetate; sulfuric acid ester salts such as sulfated linear primary alcohols, sulfated polyoxyethylenated straight-chain alcohols and sulfated triglyceride oils; phosphoric and polyphosphoric acid esters; perfluorinated carboxylic acids; and polymeric anionic surfactants such as alginic acid. These and other anionic surfactants are discussed in Rosen, "Surfactants and Interfacial Phenomena," John Wiley & Sons, pp. 7–16, 1989. Mixtures or combinations of anionic surfactants may also be utilized as the particle component. Sodium dodecyl sulfate is the presently preferred anionic surfactant for use in the present invention.

The particle component typically comprises from about 10 to about 50, preferably from about 30 to about 45, percent by weight of the total electrorheological material depending on the specific particle being used, the desired electroactivity and the viscosity of the overall fluid. The particular amount of particle component required in individual materials will be apparent to those skilled in the art.

A small amount of activator is required for the present electrorheological material to exhibit proper electrorheological activity. Typical activators for use in the present invention include water and other molecules containing hydroxyl, carboxyl or amine functionality. Typical activators other than water include methyl, ethyl, propyl, isopropyl, butyl and hexyl alcohols, ethylene glycol, diethylene glycol, propylene glycol, glycerol; formic, acetic and lactic acids; aliphatic, aromatic and heterocyclic amines, including primary, secondary and tertiary amino alcohols and amino esters which have from 1–16 atoms of carbon in the molecule; methyl, butyl, octyl, dodecyl, hexadecyl, diethyl, diisopropyl and dibutyl amines, ethanolamine, propanolamine, ethoxyethylamine, dioctylomine, triethylamine, trimethylomine, tributylamine, ethylenediamine, propylene-diamine, triethanolamine, triethylenetetramine, pyridine, morpholine and imidazole; and mixtures thereof. Water is the preferred activator for use in the present invention. The activator is utilized in an amount from about 0.1 to about 10, preferably from about 0.5 to about 5.0, percent by weight relative to the weight of the particle component.

An additional surfactant to further disperse the particle component may also be utilized in the present invention. Such surfactants include known surfactants or dispersing agents such as the ionic surfactants discussed in U.S. Pat. No. 3,047,507 (incorporated herein by reference) but preferably comprise non-ionic surfactants such as the steric stabilizing amino-functional, hydroxy-functional, acetoxy-functional, or alkoxy-functional polysiloxanes such as those disclosed in U.S. Pat. No. 4,645,614 (incorporated herein by reference). Other steric stabilizers such as graft and block copolymers may be utilized as an additional surfactant for the present invention and such other steric stabilizers as, for example, block copolymers of poly(ethylene oxide) and poly(propylene oxide) are disclosed in detail in U.S. Pat. No. 4,772,407 (incorporated herein by reference) and in Napper, "Polymeric Stabilization of Colloidal Dispersions," Academic Press, London, 1983. The additional surfactant, if utilized, is preferably an amino-functional polydimethylsiloxane. The additional surfactant is typically utilized in an amount from about 0.1 to about 10 percent by weight relative to the weight of the particle component.

The electrorheological materials of the present invention can be prepared by simply mixing together the carrier fluid, the particle component and the activator. If water is used as an activator, the corresponding electrorheological material is preferably prepared by drying the particle component in a convection oven at a temperature of from about 110° C. to about 150° C. for a period of time from about 3 hours to about 24 hours and subsequently allowing the particle component to absorb the desired amount of water from the atmosphere. The ingredients of the electrorheological materials may be initially mixed together by hand with a spatula or the like and then subsequently more thoroughly mixed with a mechanical mixer or shaker.

Evaluation of the properties and characteristics of the electrorheological materials of the present invention, as well as other electrorheological materials, can be carried out by directing the fluids through a defined channel, the sides of which form parallel electrodes with definite spacing therebetween. A pressure transducer measures the pressure drop between the entry and exit ends of the flow channel as a function of applied voltage. By keeping flow rates low, the viscous contribution to the pressure drop is kept negligible. Induced yield stress (T) is calculated according to the following formula:

$$T=dp(B/2L)$$

where dp represents the pressure drop, L is the length of the channel and B is the electrode spacing. The numerical constant 2 is generally valid for the normally encountered ranges of flow rates, viscosities, yield stresses and flow channel sizes. In its strictest sense, this constant can have a value between 2 and 3, a detailed discussion of which is given in R. W. Phillips "Engineering Applications of Fluids With a Variable Yield Stress," Ph. D. Thesis, University of California, Berkley, 1969.

The following examples are given to illustrate the invention and should not be construed to limit the scope of the invention.

EXAMPLE 1

To a Thermolyne convection oven maintained a temperature of 116° C. was added 70 g of sodium dodecyl sulfate obtained from Sigma Chemical Company. The sodium dodecyl sulfate was dried for a period of 24 hours in the convection oven and then allowed to absorb 0.35 g of water from the atmosphere. The water activated sodium dodecyl sulfate was added to 100 g of 10 mPa·s silicone oil obtained from Union Carbide Corporation. The ingredients were thoroughly mixed with a spatula and then vigorously shaken with a Red Devil mechanical shaker.

EXAMPLE 2

An electrorheological material was prepared according to the method disclosed in Example 1 except that 20 g of N-dodecanoyl-N-methylglycine sodium salt was utilized as the particle component which was activated with 0.5 g of water.

EXAMPLE 3

An electrorheological material was prepared according to the method disclosed in Example 1 except that 40 g of lithium dodecyl sulfate was utilized as the particle component which was activated with 0.4 g of water.

EXAMPLE 4

An electrorheological material was prepared according to the method disclosed in Example 1 except that 70 g of sodium dodecylbenzenesulfonate was utilized as the particle component which was activated with 1.7 g of water.

EXAMPLE 5

An electrorheological material was prepared according to the method disclosed in Example 1 except that 70 g of alginic acid sodium salt was utilized as the particle component which was activated with 2.1 g of water.

ELECTRORHEOLOGICAL ACTIVITY

Each of the electrorheological materials prepared in Examples 1-5 were tested for electrorheological activity and the results are indicated in Table 1 below.

TABLE 1*

| Example # | Electric Field (kV/mm) | Yield Stress (Pa) |
|---|---|---|
| 1 | 4.5 | 430 |
| 3 | 4.0 | 410 |

*Examples 2, 4, and 5 exhibited a significant electrorheological effect when exposed to an electrical probe operated at 1.0 kV/mm.

It is understood that the foregoing is a description of the preferred embodiments of the present invention and that the scope of the invention is not limited to the specific terms and conditions set forth above but is determined by the following claims.

What is claimed is:

1. An electrorheological material consisting essentially of an electrically insulating hydrophobic carrier fluid present in an amount from about 50 to about 90 percent by weight of the total material, anionic surfactant particles present in an amount from about 10 to about 50 percent by weight of the total material, and an activator present in an amount from about 0.1 to about 10 percent by weight relative to the weight of the surfactant particles.

2. An electrorheological material according to claim 1 wherein the carrier fluid is selected from the group consisting of mineral oils, white oils, paraffin oils, chlorinated hydrocarbons, silicone oils, transformer oils, halogenated aromatic liquids, halogenated paraffins, polyoxyalkylenes, and fluorinated hydrocarbons.

3. An electrorheological material according to claim 1 wherein the carrier fluid is silicone oil having a viscosity of between about 0.65 and 1000 mPa·s.

4. An electrorheological material according to claim 1 wherein the particle component is selected from the group consisting of fatty acid salts; alkyl aryl sulfonates; alkyl sulfates; alkyl sulfonates; and sulfated and sulfonated amides, amines and esters.

5. An electrorheological material according to claim 1 wherein the particle component is selected from the group consisting of sodium dodecyl sulfate, lithium dodecyl sulfate, N-dodecanoyl-N-methylglycine sodium salt, sodium dodecylbenzenesulfonate and alginic acid.

6. An electrorheological material according to claim 5 wherein the particle component is sodium dodecyl sulfate.

7. An electrorheological material according to claim 1 wherein the activator is selected from the group consisting of water, ethylene glycol, and diethylamine.

8. An electrorheological material according to claim 7 wherein the activator is water.

9. An electrorheological material according to claim 1 further comprising an additional surfactant.

10. An electrorheological material according to claim 9 wherein the additional surfactant is a steric stabilizer selected from the group consisting of amino-, hydroxy-, acetoxy-, or alkoxy-functional polysiloxanes and graft or block copolymers.

11. An electrorheological material according to claim 10 wherein the additional surfactant is an amino-functional polydimethylsiloxane.

12. An electrorheological material consisting essentially of silicone oil having a viscosity of between about 0.65 and 1000 mPa·s, sodium dodecyl sulfate, and water wherein the water is present in an amount from about 0.1 to about 10 percent by weight relative to the weight of the sodium dodecyl sulfate.

13. An electrorheological material according to claim 12 wherein the silicone oil is present in an amount of from about 55 to about 70 percent by weight of the total material, the sodium dodecyl sulfate is present in an amount of from about 30 to about 45 percent by weight of the total material, and the water is present in an amount of from about 0.5 to about 5.0 percent by weight relative to the weight of the sodium dodecyl sulfate.

14. An electrorheological material according to claim 13 further comprising an amino-functional polydimethylsiloxane.

* * * * *